United States Patent [19]

Okamura, Sr.

[11] Patent Number: 4,741,053

[45] Date of Patent: May 3, 1988

[54] CONVERTIBLE SUNVISOR CAP

[76] Inventor: Edward T. Okamura, Sr., 2209 Young St., Honolulu, Hi. 96826

[21] Appl. No.: 30,923

[22] Filed: Mar. 27, 1987

[51] Int. Cl.[4] ..... A42B 1/24

[52] U.S. Cl. ..... 2/196; 2/12

[58] Field of Search ..... 2/196, 209.1, 12, 171.5, 2/209.5, 4, 171.4, 171.1, 171.2, 171.3, 171.6, 171.7

[56] References Cited

U.S. PATENT DOCUMENTS 3,261,028 7/1966 Coletta ..... 2/12 X
3,475,766 11/1969 Raschke ..... 2/9
4,023,212 5/1977 Huffman ..... 2/197
4,556,993 12/1985 Okamura, Sr. ..... 2/196

*Primary Examiner*—Peter Nerbun
*Attorney, Agent, or Firm*—James Creighton Wray

[57] ABSTRACT

A convertible sunvisor cap has an adjustable support band which carries a rearward portion of the crown. The support band is pivotally and slidably connected to the head band such that the support band can be adjusted in length to correspond to adjustments made in the head band such that in the cap position of the crown, the support band fits snugly over a rearward portion of the head band.

19 Claims, 1 Drawing Sheet

CONVERTIBLE SUNVISOR CAP

BACKGROUND OF THE INVENTION

The present invention is an improvement over my previous invention which is embodied in U.S. Pat. No. 4,556,993 entitled "Convertible Sunvisor Cap."

The focus of my prior patent is on a hat which converts from a visor to a cap, depending on the needs of the wearer. To facilitate the previous invention, a support band pivotally connected to opposite sides of the head band carried a rearward portion of the crown so that when the support band was pivoted forwardly the crown portion would collapse and be gathered at a rearward portion of the bill. In the cap mode of operation, the support band would be pivoted rearwardly to a substantially horizontal position in which the support band would overlie the head band.

When adjustments were made to my previously patented device in the head band, no means were provided to allow similar adjustments in the support band. The result was that as the head band was adjusted to increasingly smaller dimensions, the support band became relatively larger such that when the support band was pulled back in the cap mode of operation, an unsightly gap would form between the head band and the support band. In addition, the gap made it more difficult for the support band to remain in its desired horizontal position.

SUMMARY OF THE INVENTION

The present invention solves the problem discussed above by providing an adjustable support band. By adjusting the length of the support band, a snug fit can be created between the support band the head band at a rearward portion thereof such that when the device is in the cap mode, the support band is held in position by the snug fit. Previously, a snug fit may have existed for certain sizes of the head band. However, when the head band is adjusted to a smaller size, a less than snug fit would be created which would make it difficult for the support band to remain in position.

The present invention is used for a hat that is convertible from visor to cap modes of operation by simply moving the support band. A cloth crown has a forward portion connected to a rearward portion of the bill and a rearward portion carried by the support band. The support band is generally an elongated strip of flexible plastic material and is connected at opposite sides of the head band and by so by doing is naturally bent into an arch or loop having a diameter generally defined by the distance between the two opposite points of pivotal connection.

The head band can be adjusted in any of the known ways which use complementary fasteners, such as snap fasteners and microhook and microloop fasteners. Generally speaking, adjustments in the had band create variations in the diameter of the head band.

An important object of the invention is to provide means for adjusting the support band to corresponding to adjustments made in the head band.

An object of the invention is to provide an adjustable support band apparatus for use with a convertible sunvisor cap having an adjustable head band connected to a bill and a crown movable between sunvisor and cap positions comprising, an elongated support band adapted to carry a rearward portion of the crown, means for connecting opposite end portions of the support band to the head band, and means for adjusting the length of the support band between the connection means.

In another embodiment, the connecting means comprise two fasteners connected to diametrically opposite sides of the head band.

In another embodiment, the two fasteners define a pivot axis for the elongated band and provide means for pivoting the support band between sunvisor and cap positions.

Preferably, each fastener has a medial portion that extends radially outwardly from the head band.

The support band is provided with slots in opposite end portions which slidably receive the medial portions of the two fasteners, and the slots and fasteners define the adjusting means.

Preferably, each fastener has headed portions opposite ends of the medial portion.

Preferably, the support band is made of flexible plastic.

In another embodiment, the two fasteners comprise rivets. The rivets may be two-part rivets, each part having a headed portion.

Another object of the invention is to provide an improvement for a convertible sunvisor cap having an adjustable head band, a bill, and a crown movable between sunvisor and cap positions, the improvement comprising, a support band, pivotally connected to the head band at opposite sides of the head band, the support band carrying a rearward portion of the crown, and a forward portion of the crown being connected to the bill, and means for adjusting the length of the support band between points of pivotal connection of the support band.

Preferably, the adjusting means comprise, a slot provided in each opposite end portion of the support band and two fasteners, connected to the head band, and having radially extending portion slidably received in the slots, whereby the position of the fasteners with respect to the slots determines the length of the support band which preferably approximates the length of the head band between the two fasteners.

In a preferred embodiment, the slots have a width slightly smaller than a diameter of the fasteners at the radially extending portion, and wherein ends of the slots have slightly enlarged widths, whereby the enlarged ends provide full-in and full-out adjustment stops, and whereby the smaller width between the two enlarged ends provides resistance to relative movement between the slots and fasteners.

Preferably, the fasteners have headed opposite end portions, one headed portion providing means for connecting the fasteners to the head band, and the other headed portion providing means for preventing the fasteners from separating from the slot.

The fasteners may comprise two-part rivets, each part having a headed portion and one part receiving the other part in a malefemale connection whereby the head band is pinched between the headed portion of the female connection part and a flared end portion of the male connection part.

Another object is to provide a method of converting a hat from a sunvisor to a cap and adjusting either to a user's head size comprising, adjusting the length of a head band to a diameter approximately equal to a diameter of the user's head, moving a crown of the hat between cap and sunvisor positions, wherein a rearward portion of the crown is carried by a support band which is pivotally connected to opposite sides of the head band with fasteners slidably received in slots provided in opposite end portions of the support band, and adjusting the length of the support band by moving the position of the fasteners within the slots until the length of the support band between the fasteners approximates the length of the head band between the fasteners. Adjustments in the support band correspond to adjustments in the head band.

DETAILED DESCRIPTION OF THE DRAWINGS

Figure 1:
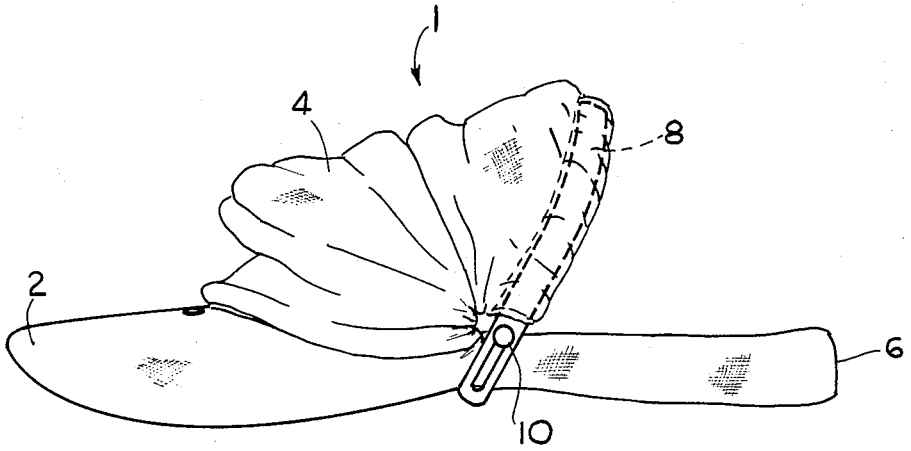
FIG. 1 is a side perspective view of a preferred embodiment of the invention.

Referring to FIG. 1, the numeral 1 refers generally to a hat that is convertible between sunvisor and cap modes of operation. In FIG. 1, the hat is shown in between the two different modes of operation for the purposes of illustration. The hat has a bill 2, a crown 4 and a head band 6. The crown 4 is connected generally to a rearward portion of the bill 2. A rearward portion of the crown 4 is carried by a support band 8 which is pivotally connected to the head band 6 by fasteners 10.

The head band 6 is at least partially covered with cloth material which is preferably the same material that covers the bill 2 and comprises the crown 4. The bill 2 and the head band 6 support and shape the cloth material that covers each, while the crown 4 has no support for the cloth material other than the support band 8. When the support band 8 is moved rearwardly to a horizontal position, a canopy is formed in which the crown 4 covers the user's head. In effect, the user's head supports the crown and shapes the crown.

Figure 1A:
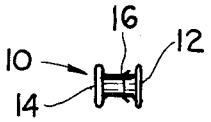
FIG. 1A is a detail side view of a preferred fastener used in the embodiment of FIG. 1.

The support band 8 is pivotally connected to the head band 6 by fasteners 10. Preferred fasteners are shown in detail in FIG. 1a. The fastener 10 generally has opposite end headed portions 12, 14 separated by a medial portion 16. In a preferred embodiment, the fastener is a two-part preformed rivit in which each part includes a headed portion and a post. One part slideably receives the other part in order to assembly the fastener with a male-female connection. In that case, the part having headed portion 14, which is the male part, has a flared end portion or any other outward extending protrusions, such that when assembling the device, the headed portion 12 of the female part is disposed on an inner surface of the head band and the flared portion of the male part pinches the head band between the headed portion 12 and the flared end. This accomplishes a tight connection between the head band and the fastener. A substantial lengt of the medial portion 16 extends outwardly from the connected end of the fastener to provide a slideable connection between the head band 6 and the support band 8.

Figure 3:
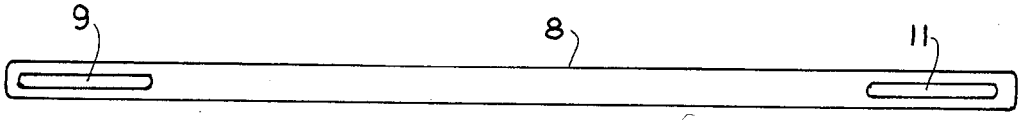
FIG. 3 is a side elevation view of the preferred support strap.

In order to accomplish adjustments of the support band 8, end portions of the support band 8 are provided with slots 9, 11 which are shown in more detail in FIG. 3.

Figure 2:
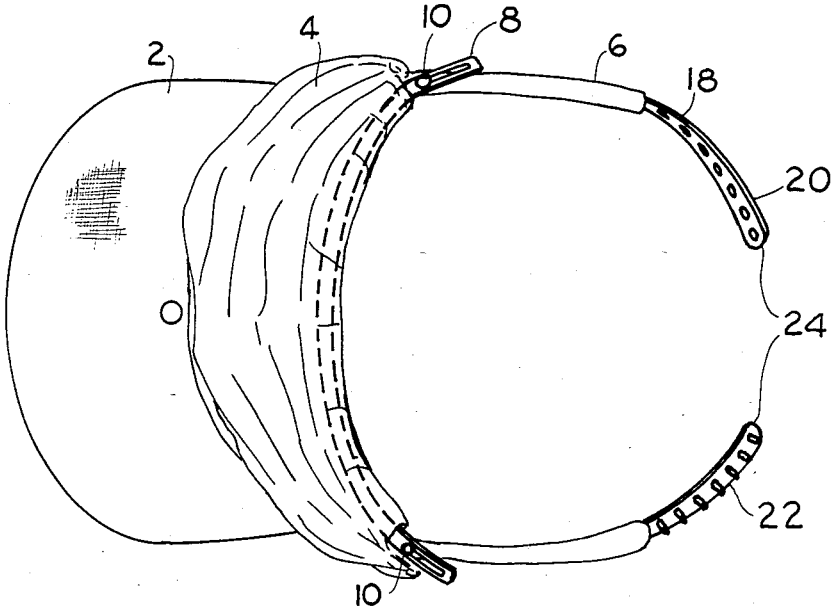
FIG. 2 is a top plan view of the embodiment of FIG. 1.

In FIGS. 1 and 2, for the purposes of illustration, the fasteners 10 are shown in their fully inwardmost adjustment position. The length of the support band 8 between the two fasteners 10 can easily be adjusted by sliding the fasteners 10 within the slots 9 and 11. In the illustrations of FIGS. 1 and 2, the length of the support band 8 is at its shortest.

As shown in FIG. 2, the length of the head band 6 can be adjusted by means of known complementary fasteners provided on opposite halves 18, 22 of the head band. In the illustration of FIG. 2, snap fasteners are illustrated in which snaps provided on half 22 are snap fitted into holes 20 provided on half 18. Spacing between the snaps and the holes are equal so that a variable overlap between end portions 24 of head band 6 can be created. As can easily be appreciated, the greater the overlap the smaller the diameter of the head band.

Figure 4:
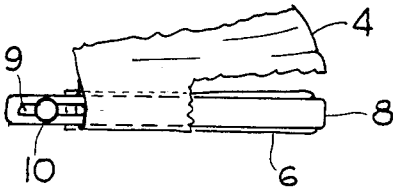
FIG. 4 is a detail side view, partly in section, of the embodiment of FIG. 1 with the support strap overlying the head strap.

For a given adjustment of the head band, the support band can be adjusted to correspond in length so that, measured from the fasteners 10, the length of the head band and the length of the support strap approximately coincide. This feature is shown in FIG. 4 in which for the sake of illustration, the fastener 10 is shown in a substantially medial position along the slot 9. FIG. 4 shows the preferred implementation of the adjustable support band in which the support band 8 snugly fits over the head band 6 in the cap mode of operation in which the crown 4 extends from the bill to the rearward portion of the head band to create the canopy.

Preferably, the width of the slots 9, 11 is slightly smaller than the diameter of the fasteners 10 at the medial portion 16. This creates an interference fit which discourages unwanted sliding of the fasteners within the slots way from an adjusted position. Also, it is preferable that the opposite ends of each slot are enlarged so that the support band 8 provides resistance against the full-in or full-out adjustment due to the fact that the fastener 10 becomes lodged in the slightly enlarged ends. This resistance can be overcome by applying a slight force. However, it may be desirable when the hat is in the visor mode to have the support band adjusted to the full-in position irrespective of the adjustment of the head band 6. This is simply to keep the support band from sliding freely over the fasteners 10 in the visor position.

As shown in FIG. 4, the support band 8 carried a rearward portion of the crown 4 in such a way that the cloth material is not acutally physically connected to the support band. Preferably, the cloth material of the crown 4 is wrapped around the support band 8 and sewn to itself. The support band is preferably made of flexible plastic material, with enough resiliency so that the slots 9, 11 can expand and contract to accommodate the lager sized fastener 10.

The preferred fasteners 10 constitute stamped metal but may be made of other suitable means.

As shown in my prior patent, the bill 2 may be provided with means to fasten the collapsed crown in the visor position to a rearward portion of the bill. A preferred means includes a short strap connected to the back end of the crown at one end with the opposite end being provided with a snap fastener which complements another snap fastener on the bill.

I claim:

1. An adjustable support band apparatus for use with a convertible sunvisor cap having an adjustable head band connected to a bill and a crown movable between sunvisor and cap positions comprising, an elongated support band adapted to carry a rearward portion of the crown, wherein the support band is pivotally movable from one end of the head band to the opposite end, means for pivotally connecting and slideably receiving opposite end portions of the support band to the head band, and means for adjusting the length of the support band between the connection means to coincide with the length of the head band between the connecting means.

2. The apparatus of claim 1 wherein the connecting means comprise two fasteners fixedly connected to diametrically opposite sides of the head band.

3. The apparatus of claim 2 wherein the two fasteners define a pivot axis for the elongated band and provide means for pivoting the support band between sunvisor and cap positions.

4. The apparatus of claim 2 wherein each fastener has a medial portion that extends radially outwardly from the head band.

5. The apparatus of claim 4 wherein the support band is provided with slots in opposite end portions which slideably receive the medial portions of the two fasteners.

6. The apparatus of claim 5 wherein the slots and fasteners define the adjusting means.

7. The apparatus of claim 4 wherein each fastener has headed portions opposite ends of the medial portion.

8. The apparatus of claim 1 wherein the support band is made of flexible plastic.

9. The apparatus of claim 2 wherein the two fasteners comprise rivets.

10. The apparatus of claim 9 wherein the rivets are twopart rivtes, each part having a headed portion.

11. In a convertible sunvisor cap having an adjustable head band, a bill, and a crown movable between sunvisor and cap position, the improvement comprising, a support band, pivotally connected to the head band at opposite sides of the head band, the support band carrying a rearward portion of the crown, and a forward portion of the crown being connected to the bill, wherein the support band is pivotally movable from one end of the head band to the opposite end, and means for adjusting the length of the support band between points of pivotal connection of the support band to coincide with the length of the head band between the connecting means.

12. The device of claim 11 wherein the adjusting means comprise, a slot provided in each opposite end portion of the support band and two fasteners, connected to the head band, and having radially extending portions slidably received in the slots, whereby the position of the fasteners with respect to the slots determines the length of the support band which preferably approximates the length of the head band between the two fasteners.

13. The device of claim 12 wherein the support band is made of flexible plastic.

14. The device of claim 13 wherein the slots have a width slightly smaller than a diameter of the fasteners at the radially extending portion, and wherein ends of the slots have slightly enlarged widths, whereby the enlarged ends provide full-in and full-out adjustment stops, and whereby the smaller width between the two enlarged ends provides resistance to relative movement between the slots and fasteners.

15. The device of claim 14 wherein the fasteners have headed opposite end portions, one headed portion providing means for connecting the fasteners to the head band, and the other headed portion providing means for preventing the fasteners from separating from the slot.

16. The device of claim 14 wherein the fasteners comprise rivets.

17. The device of claim 16 wherein the rivets are two-part rivets, each part having a headed portion and one part receiving the other part in a male-female connection whereby the head band is pinched between the headed portion of the female connection part and a flared end portion of the male connection part.

18. A method of converting a hat from a sunvisor to a cap and adjusting either to a user's head size comprising, adjusting the length of a head band to a diameter approximately equal to a diameter of the user's head, moving a crown of the hat between cap and sunvisor positions, wherein a rearward portion of the crown is carried by a support band which is pivotally connected to opposite sides of the head band with fasteners slidably received in slots provided in opposite end portions of the support band, and adjusting the length of the support band by moving the position of the fasteners within the slots thereby adjusting the pivot axis of the support band until the length of the support band between the fasteners approximates the length of the head band between the fasteners.

19. The method of claim 18 wherein adjustments in the support band correspond to adjustments in the head band.

* * * * *